United States Patent [19]

Janiw

[11] Patent Number: 5,054,203

[45] Date of Patent: Oct. 8, 1991

[54] ADJUSTABLE CAN OPENER

[76] Inventor: Dusan Janiw, P.O. Box 510 964, Salt Lake City, Utah 84151

[21] Appl. No.: 559,676

[22] Filed: Jul. 23, 1990

[51] Int. Cl.[5] ..... B67B 7/16

[52] U.S. Cl. ..... 30/408; 30/400; 30/444; B67B/7/46

[58] Field of Search ..... 30/408, 400, 407, 410, 30/433, 443, 444

[56] References Cited

U.S. PATENT DOCUMENTS 575,654 1/1897 Leschinski ..... 30/408

618,426 1/1899 Middlekauff ..... 30/408

*Primary Examiner*—Timothy V. Eley

*Assistant Examiner*—William Frioie, Jr.

*Attorney, Agent, or Firm*—Leon Gilden

[57] ABSTRACT

Apparatus including an elongate longitudinally aligned cylindrical shank with a handle integrally and coaxially mounted to a rear terminal end of the shank. An S-shaped piercing guide is integrally mounted to a forward terminal end of the shank. The guide includes an abutment collar mounted on the shank adjacent the guide limiting projection of the guide within a can lid. A slidable cutter and guide assembly is adjustably mounted along the shank to accommodate cans of various diameters when the piercing guide is directed within an associated can lid to provide a central point of rotation of the apparatus relative to an associated can.

1 Claim, 4 Drawing Sheets

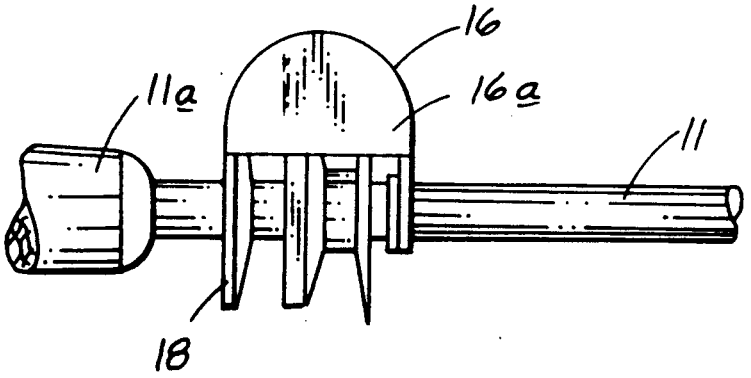
Fig 8
Fig 9
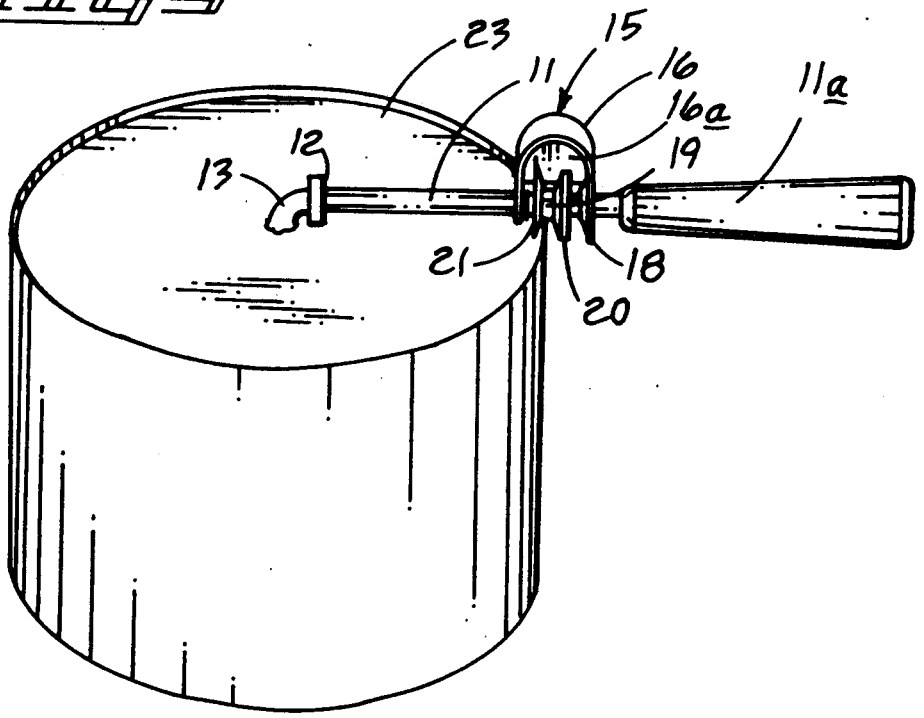

ADJUSTABLE CAN OPENER

BACKGROUND OF THE INVENTION

1. Field of the Invention

The field of the invention relates to can openers, and more particularly pertains to a new and improved adjustable can opener accommodating variations in can diameter and providing a structure temporarily mounted within a can organization to secure the can opener relative to the can during use.

2. Description of the Prior Art

Can openers of various types are utilized in the prior art. Manually manipulated can openers that are circumferentially directed about a can lid to severe the same from the associated can body are utilized. Prior art can openers have at times utilized structure to secure the can opening apparatus to a can body at the seam interface of the can lid and the can body. Other can opening structure initially pierces the can lid with a hook shaped member and is directed about the can lid utilizing the can body as a guide. Such apparatus has it's disadvantages and limitations due to the tenuous securement of the can opening structure relative to the can permitting unforseen accidents and injury to occur should the can opening apparatus loose association with the associated can. The instant invention attempts to overcome deficiencies of the prior art to avoid such inadvertent disengagement of a can opener relative to a can by providing a positive interrelationship of the can opener relative to the can during use. Examples of the prior art can opening structure may be found in U.S. Pat. No. 1,216,024 to BANLUVEN wherein an L-shaped hook is projected within a can and pivoted about the can to severe the can by fulcruming the organization relative to the can lid.

U.S. Pat. No. 2,436,133 to WHITE provides a further example of a can opening apparatus utilizing an L-shaped type hook as noted in the BANLUVEN Patent but further includes a pressure pad for application of a thumb by an individual to provide enhanced leverage in application of force to the can opening structure.

U.S. Pat. No. 3,358,366 to VOLLRATH utilizes a can opening structure that attempts to engage a seam of a can body and a can lid to provide anchoring for the can opening structure during use.

U.S. Pat. No. 2,804,683 to HAMMOND utilizes a generally L-shaped hook structure to severe a can relative to an associated can body.

U.S. Pat. No. 1,734,517 to GARRISON sets forth a further example utilizing an underlying L-shaped hook relative to a overlying body to provide fulcruming leverage to the hook as it is directed circumferentially about the can lid.

As such, it may be appreciated that there continues to be a need for a new and improved adjustable can opener as set forth by the instant invention which addresses both the problems of ease of use as well as effectiveness in construction in securely anchoring the can opener apparatus to an associated can during a can opening procedure and as such, the present invention substantially fulfills this need.

SUMMARY OF THE INVENTION

In view of the foregoing disadvantages inherent in the known types of can openers present in the prior art, the present invention provides a new and improved adjustable can opener wherein the same securably mounts the apparatus to a can lid providing a rotational pivot base for annularly directing the apparatus about a can lid to severe the lid from an associated can. As such, the general purpose of the present invention, which will be described subsequently in greater detail, is to provide a new and improved adjustable can opener which has all the advantages of the prior art can opener apparatus and none of the disadvantages.

To attain this, the adjustable can opener of the invention includes apparatus including an elongate longitudinally aligned cylindrical shank with a handle integrally and coaxially mounted to a rear terminal end of the shank. An S-shaped piercing guide is integrally mounted to a forward terminal end of the shank. The guide includes an abutment collar mounted on the shank adjacent the guide limiting projection of the guide within a can lid. A slidable cutter and guide assembly is adjustably mounted along the shank to accommodate cans of various diameters when the piercing guide is directed within an associated can lid to provide a central point of rotation of the apparatus relative to an associated can.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable can opener which has all the advantages of the prior art can opener apparatus and none of the disadvantages.

It is another object of the present invention to provide a new and improved adjustable can opener which may be easily and efficiently manufactured and marketed.

It is a further object of the present invention to provide a new and improved adjustable can opener which is of a durable and reliable construction.

An even further object of the present invention is to provide a new and improved adjustable can opener which is susceptible of a low cost of manufacture with regard to both materials and labor, and which accordingly is then susceptible of low prices of sale to the consuming public, thereby making such adjustable can openers economically available to the buying public.

Still yet another object of the present invention is to provide a new and improved adjustable can opener which provides in the apparatuses and methods of the prior art some of the advantages thereof, while simultaneously overcoming some of the disadvantages normally associated therewith.

Still another object of the present invention is to provide a new and improved adjustable can opener which may be compactly stored when not being utilized.

Yet another object of the present invention is to provide a new and improved adjustable can opener wherein the same is fixedly mounted within a can structure to securely anchor the apparatus during a can opening procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic view taken along the lines 8—8 of FIG. 6 in the direction indicated by the arrows.

FIG. 9 is an isometric illustration of the instant invention in use in association with a conventional can.

DESCRIPTION OF THE PREFERRED EMBODIMENT

Figure 1:
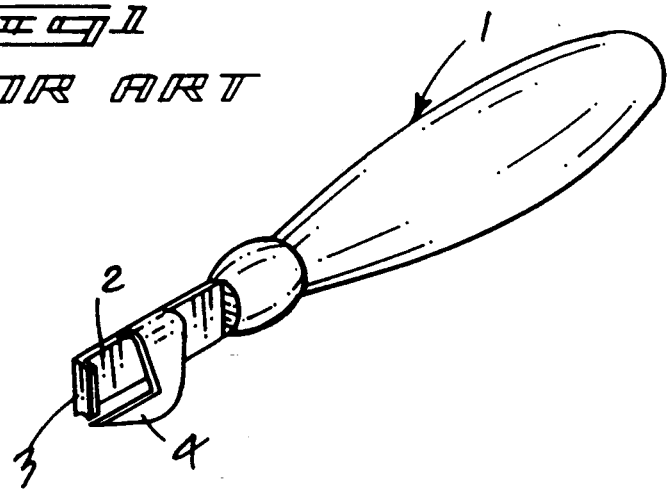
Fig 1 PRIOR ART
FIG. 1 is an isometric illustration of a prior art can opener.

With reference now to the drawings, and in particular to FIGS. 1 to 9 thereof, a new and improved adjustable can opener embodying the principles and concepts of the present invention and generally designated by the reference numeral 10 will be described.

Figure 2:
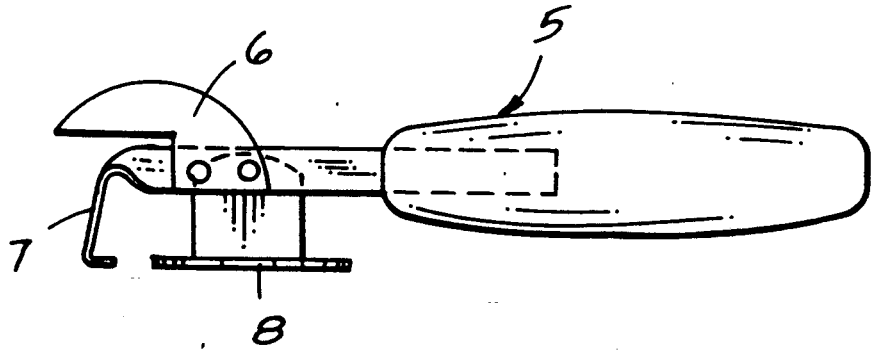
Fig 2 PRIOR ART
FIG. 2 is an orthographic side view taken in elevation of a further example of a prior art can opener.

FIG. 1 illustrates a prior art can opener 1 utilizing an elongate shank 2 mounting a fulcrum plate 3 to engage a seam of a can as the generally L-shaped hook 4 is projected within the can lid to permit manual pivotment of the apparatus about an existing can lid. FIG. 2 illustrates a further example of a prior art can opener 5 wherein the fulcrum pad 7 cooperates with the L-shaped hook 6 in a manner as illustrated in FIG. 1 but further includes a pressure pad 8 for application of an individual's thumb or the like thereon to enhance manual securement of the organization in use.

Figure 3:
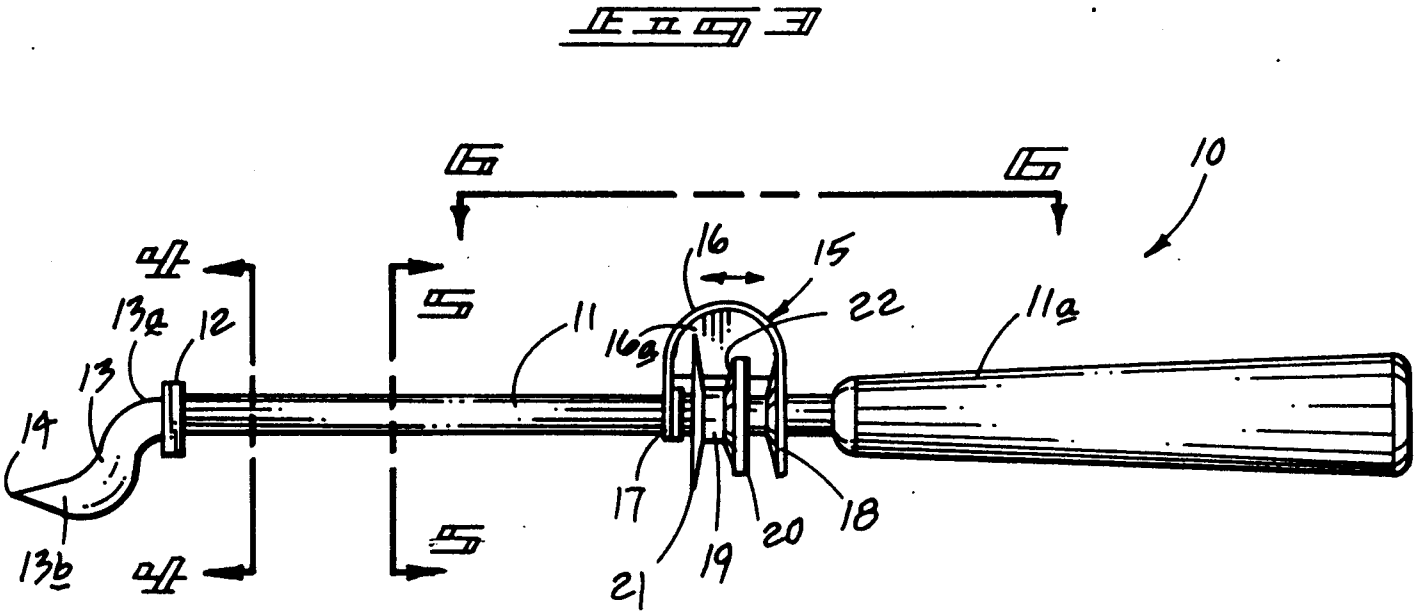
FIG. 3 is an orthographic side view taken in elevation of the instant invention.
Figure 4:
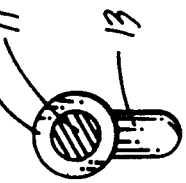
FIG. 4 is an orthographic view taken along the lines 4—4 of FIG. 3 in the direction indicated by the arrows.
Figure 5:
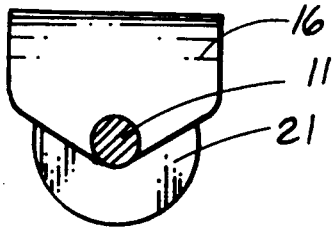
FIG. 5 is an orthographic view taken along the lines 5—5 of FIG. 3 in the direction indicated by the arrows.
Figure 6:
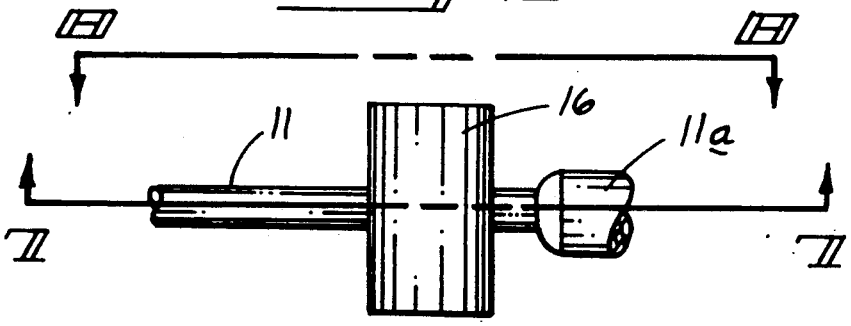
FIG. 6 is an orthographic view taken along the lines 6—6 of FIG. 3 in the direction indicated by the arrows.
Figure 7:
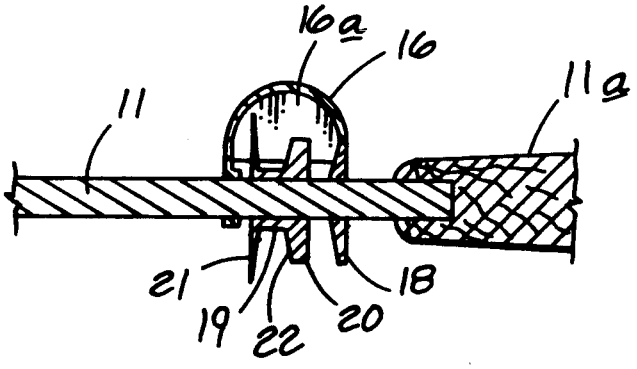
FIG. 7 is an orthographic view taken along the lines 7—7 of FIG. 6 in the direction indicated by the arrows.

More specifically, the adjustable can opener apparatus 10 of the instant invention essentially comprises, an elongate cylindrical shaft 11 of a predetermined diameter with a handle **11*a* coaxially aligned with and extending rearwardly of the cylindrical shaft 11. An abutment collar 12 is defined by a collar diameter greater than that defined by the predetermined diameter of the shaft. The generally S-shaped piercing guide 13 projects forwardly of the shaft 11 and includes a top guide leg 13*a* substantially aligned with the cylindrical shaft 11 with a bottom guide leg 13*b* arranged generally parallel to and underlying the shaft 11 and projecting forwardly thereof as illustrated. The forward terminal end of the bottom guide leg 13*b* terminates in a sharpened piercer point 14. The S-shaped guide 13 is defined by a general cross-sectional configuration defining a diameter substantially equal to the predetermined diameter of the cylindrical shaft 11 wherein the abutment collar 12 prevents projection of the guide 13 within a can lid 23 beyond the collar 12 during a piercing and projection of the guide 13 within a can lid for use as a pivot point in a manner as illustrated in FIG. 9. A slidable shield 15 overlies in surrounding relationship an underlying cutter assembly as illustrated in FIG. 3 for example. The shield 15 includes a U-shaped top cover 16 and a side cover 16*a* arranged on a right side of the top cover substantially enclosing an interior cavity defined by the U-shaped cover between the shaft 11 and the interior surface of the cover 16. The U-shaped top cover 16 is mounted to a forward slide collar 17 at its forward terminal end wherein the forward slide collar is slidable relative to the shaft 11 and wherein the U-shaped top cover 16 is mounted to a rear slide collar 18 at its rear terminal end adjacent the handle 11*a* wherein the rear collar 18 is of a diameter greater than that of the forward collar 17 to further protect and prevent an individual's fingers from inadvertently entering the cutter assembly portion of the apparatus. The cutter assembly portion as noted includes a tubular hub 19 rotatably and slidably mounted about the shaft 11 between the forward and rear slide collar 17 and 18. A guide roller 20 is integrally mounted at a rear terminal end of the tubular hub 19 defined by a first diameter and further includes a conical guide surface 22 directed towards the tubular hub 19 and an annular cutter disk 21 defined by a second diameter greater than that of the first diameter to permit engagement of the cutter disk 21 within a can lid 23. The conical guide surface 22 enhances positioning of the guide roller 20 to a rear surface of an associated seaming bead relative to a can body and an associated can lid 23**.

In use, the S-shaped piercing guide 13 is projected through the can lid 23 wherein the seamed portion of a can structure relative to the can lid and body wherein the annular cutter disk 21 is directed through the can lid 23 and thereafter pivoted about the S-shaped guide 13 to effect complete severing of the can lid 23 relative to it's associated can body.

FIG. 9 further illustrates a side cover **10*a* on the left and right side of the cover 16 to provide an enclosed semi-circular covering about the cutter disc 21** in use.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable can opener comprising, an elongate cylindrical shaft defined by a predetermined diameter, the shaft including a handle fixedly mounted to a rear terminal end of the shaft, and piercing means integrally mounted to a forward terminal end of the shaft for piercing and anchoring the shaft relative to a can lid, and cutter means slidably mounted on the shaft for guided securement in association with a can seam to simultaneously permit cutting of the can lid adjacent the seam, and wherein the piercing means includes an "S" shaped piercing guide, the piercing guide including a top guide leg aligned with the cylindrical shaft, and a bottom guide leg arranged parallel to the shaft underlying the shaft, and the bottom leg, including a sharpened point oriented forwardly of and below the shaft, and wherein the "S" shaped piercing guide is defined by a piercing guide diameter substantially equal to the predetermined diameter of the shaft, and including an abutment collar fixedly and orthogonally mounted to a forward terminal end of the elongate cylindrical shaft with the "S" shaped piercing guide directed forwardly of the abutment collar wherein the abutment collar defines a collar diameter substantially greater than that defined by the predetermined diameter, and wherein the cutter means includes a tubular hub slidably and rotatably mounted about the cylindrical shaft between the handle and the collar, the hub including a guide roller fixedly mounted to a rear terminal end of the hub wherein the guide roller receives the shaft therethrough, and the guide roller is defined by a guide roller diameter, and wherein the cutter means further includes an annular cutter disk defined by a disk diameter greater than that of the guide roller diameter, and the cutter disk is fixedly mounted to a forward terminal end of the hub wherein the hub and the guide roller are coaxially aligned with the hub, and further including an arcuate generally "U" shaped cover overlying the cutter means, the cover including a forward slide collar slidably mounted about the cylindrical shaft, and a rear slide collar slidably mounted about the cylindrical shaft wherein the forward slide collar is positioned forwardly of the cutter means, and the rear slide collar is mounted rearwardly of the cutter means wherein the cover overlies the cutter disk, tubular hub, and guide roller, and wherein the rear slide collar is defined by a rear slide collar diameter substantially greater than that defined by a forward slide collar diameter defined by the forward slide collar and wherein the rear slide collar diameter is substantially equal to the guide roller diameter, and wherein the cover further includes a side cover integrally mounted to a right side portion of the cover to enclose the cutter disk and guide roller within the cover.

* * * * *